US005431409A

United States Patent [19]

Webster

[11] Patent Number: 5,431,409

[45] Date of Patent: Jul. 11, 1995

[54] MOVING ARCHERY TARGET

[76] Inventor: Joel R. Webster, 2116 Murphy Ave., Shakopee, Minn. 55379

[21] Appl. No.: 273,342

[22] Filed: Jul. 11, 1994

[51] Int. Cl.[6] ..... F41J 9/00

[52] U.S. Cl. ..... 273/369; 273/366; 273/406; 273/408; 434/22

[58] Field of Search ..... 273/365–367, 273/368, 369, 406–408, 310–316; 434/22

[56] References Cited

U.S. PATENT DOCUMENTS

| | | | |
|---|---|---|---|
| Re. 30,013 | 5/1979 | Knight | 273/105.2 |
| 2,310,084 | 2/1943 | Hooker et al. | 373/101.1 |
| 2,456,034 | 12/1943 | Suydam | 273/366 |
| 3,143,811 | 8/1964 | Tucci et al. | 35/25 |
| 3,502,334 | 3/1970 | Tippit | 273/366 |
| 3,623,065 | 11/1971 | Rockwood et al. | 273/366 |
| 3,770,914 | 11/1973 | Larsen | 273/369 |
| 3,865,373 | 2/1975 | Knight | 273/369 |
| 4,072,313 | 2/1978 | Murso et al. | 273/105.2 |
| 4,076,247 | 2/1978 | Kim et al. | 273/105.6 |
| 4,340,370 | 7/1982 | Marshall et al. | 434/22 |
| 4,355,981 | 10/1982 | Kuperman et al. | 273/369 |
| 4,645,210 | 2/1987 | Patsy | 273/369 |
| 4,699,116 | 10/1987 | Freeland et al. | 124/7 |
| 5,242,172 | 9/1993 | Bateman | 273/369 |

*Primary Examiner*—Raleigh W. Chin

*Attorney, Agent, or Firm*—Westman, Champlin & Kelly

[57] ABSTRACT

An archery target method and apparatus including providing a stationary target for an archer shooting an arrow to initiate a moving target. The apparatus senses a hit on the stationary target and initiates a delay sequence. After counting down the delay sequence which allows the archer to reload a bow with a second arrow, the apparatus begins to move a moving target across a target range allowing the archer to fire at the moving target with the second arrow. The apparatus senses when the moving target reaches the end of the target range and stops the moving target at the end of the target range. The apparatus then resets the archery target to return across the target range when the second stationary target shot impacts the target. At this same time, the timing sequence is initiated again, thus repeating the alternating stationary and moving target shots. This sequence allows the archer both left to right and right to left moving targets as well as stationary target shots.

4 Claims, 8 Drawing Sheets

MOVING ARCHERY TARGET

BACKGROUND OF THE INVENTION

The present invention relates to an archery target practice method and apparatus. More specifically, the present invention relates to an archery target practice method and apparatus for practicing archery technique with alternating still and moving archery targets.

Archery has been practiced by many nations for millennia. The principle of guiding an arrow accurately to a target has been used to provide sustenance, for sport, and in some cultures has attained a spiritual quality. The basic principles of archery have remained largely unchanged with respect to today's practice of archery.

Part of archery's allure is the difficulty required in attaining effective archery shooting skills. Many hours of discipline and practice are required to accurately hit a still target. Still more discipline and skill are required to hit a target in motion. Many archers who are proficient at hitting a still target are ultimately unsuccessful when shooting at a moving target. The moving target requires that the archer mentally compute a ballistic solution that includes an estimation of a "lead" or an aim point slightly ahead of the moving target so that an arrow fired at a point in space reaches this point in space the same instant in time as the target. The leading skill is desirable to effectively hunt and it must be practiced for the archer to become proficient in the leading skill. Much of this skill involves the archer developing a "sense" or skill at target motion estimation determining target speed and combining this "sense" with a familiarity with a bow and arrow. The velocity of an arrow is dependent upon the draw weight of the bow which the archer is shooting. The archer must know the velocity of the arrow at a given draw of the bow, or as in developing the leading skill, the archer must become very familiar with the archer's own equipment such that all variables in the ballistic calculation are "sensed" or known by the archer. These "senses" can only be acquired with substantial practice and integration of the archer's physical and mental processes. This integration of mind and body is responsible for much of the enjoyment experienced by seasoned archers.

A difficulty in learning how to shoot at a moving target is actually finding an archery target range with suitable moving targets. Gunnery or firearms target ranges that have moving target systems are ill suited for the integration of archery practice with the other forms of weaponry practiced at the range. The reduced distances required for an archery range, a desired quiet to achieve the concentration necessary to shoot an arrow accurately and non-firearm style targets used in archery are all missing from a traditional gunnery range. An archer needs a range that typically is less than sixty meters in depth, and is preferably only twenty five meters to practice shooting. Most hunting archery is done at distances of less than twenty five meters. The quiet concentration required to practice archery is also required to stalk game. Therefore, a quiet practice environment provides a real world archery environment. A gunnery range makes no provision to allow the archer to recover fired arrows without stopping activity on the firing line. A traditional gunnery range target is equally ill suited for an archery target. Arrow shafts are made from wood, composites, or a lightweight metal like aluminum. Arrow heads are attached by threaded interfaces or are press fit onto the shafts. The impact of an arrow on a non archery target, especially a rigid gunnery target, can send a shock wave back through the shaft that can shatter or bend the shaft or damage the arrowhead interface. Either result will ruin the arrow and require the archer to invest in new arrows and/or arrow shaft replacement.

To find a suitable moving target range, the archer currently has few choices. Prior art includes a target throwing device tossing a target reminiscent of a clay pigeon in a skeet or trap style shooting configuration to several elaborate remote control devices designed for multiple user gunnery ranges that embody the undesirable traits of any gunnery range devices as listed above. The target throwing device simulates an aerial target which rarely is the desired target of a hunting archer. Most archery targets tend to be running or bounding type targets. Additionally, a thrown target should be retrieved, with the arrow fired at it. If the arrow is retained by the thrown target, additional damage to the arrow may result from the target falling on or in some manner deforming the arrow shaft. Other target ranges are also suited for the disposable projectile with little consideration made for the safe recovery of spent arrows.

SUMMARY OF THE INVENTION

An archery target method and apparatus including providing a stationary target for an archer firing an arrow to hit to initiate a moving target. Apparatus senses a hit on the stationary target and initiates a delay sequence. After counting down the delay sequence which allows the archer to reload a bow with a second arrow, the apparatus begins to move a moving target across a target range allowing the archer to fire at the moving target with the second arrow. The apparatus then senses when the moving target reaches the end of the target range and stops the moving target at the end of the target range. The apparatus then resets the archery target to return across the target range when the second stationary target shot impacts the target. At this same time, the timing sequence is initiated again, thus repeating the alternating stationary and moving target shots. This sequence allows the archer both left to right and right to left moving targets as well as stationary target shots.

DETAILED DESCRIPTION OF THE PREFERRED EMBODIMENTS

Figure 1:
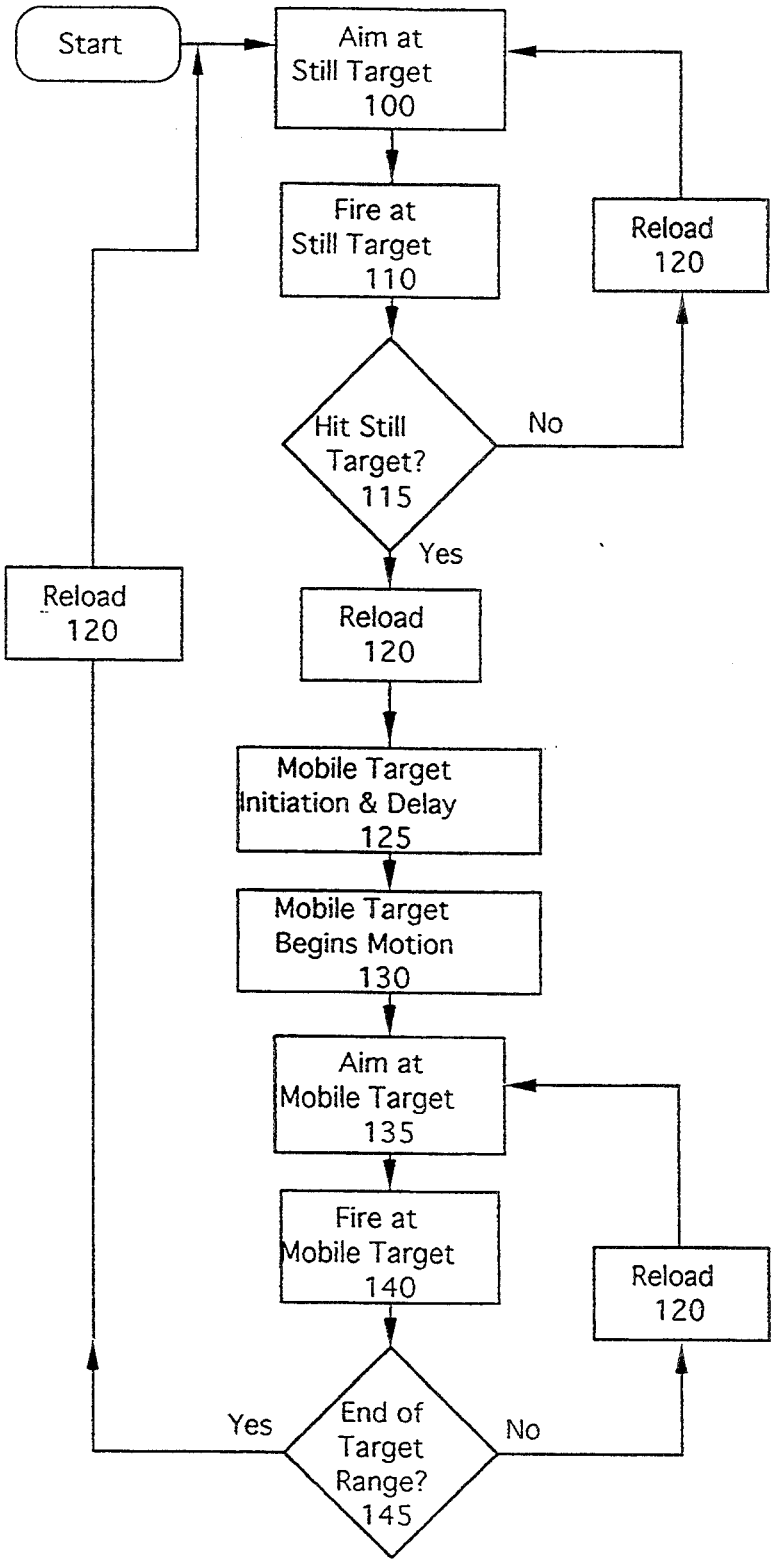
FIG. 1 is a flow diagram of the method of the present invention.

In FIG. 1, a usage of an embodiment of the present method by an archer includes the steps of aiming 100 and firing 110 an arrow at a still target affixed to a target range, hitting the still target 115, reloading the bow with an arrow 120, waiting for a moving target to begin motion 125. Once the moving target begins its motion 130, the archer aims 135 and fires the arrow 140 at the moving target as it moves across the target range. A target range is defined as the distance that the moving target 150 travels in a half cycle of target travel. A useful size for the range is three meters to twenty meters. A better size for the range is five meters to eighteen meters. A preferred size of the archery target range is eight meters to fifteen meters. The archer may reload the bow with an arrow 120 and repeat the moving firing sequence 135,140 on the same target pass if the range is sufficiently wide and/or the target motion is sufficiently slow. The moving target will stop at an opposite end of the target range 145 from where it began its movement. The archer may reactivate the moving target by reloading the bow with an arrow 120, aiming 100 and firing 110 the arrow at the first or a second still target, hitting either target 115 with the arrow, reloading yet another arrow 120 and awaiting the movement of the target 125. Once the motion begins again 130, the archer aims 135 and fires 140 the arrow at the moving target as it moves across the range to the opposite end of the target range. The archer may reload 120 and repeat the moving firing sequence 135,140 on the same target pass if the range is sufficiently wide and the target motion is sufficiently slow. The moving target will stop at an opposite end of the target range 145 from where it began its movement. The sequence may then be repeated again and again.

Several techniques of archery are capable of being developed using this method of the present invention. The archer will simultaneously develop still and motion archery techniques. The archer must develop a proficiency with still shots 115 to activate the range to make a motion shot. Once the motion of the target is activated 130, the ability to practice a leading shot is afforded to the archer. The archer must develop the firing technique of making a switch from a still shot to a moving shot, simulating a common hunting event. If the range of target motion is sufficiently long, the archer can develop speed reloading skills for multiple motion shots on a single motion pass of the target. The speed of the target motion can be made variable to require the archer to learn how to estimate ballistic approximations and lead angles at variable target speeds. The method also allows the archer to develop skill in shooting at motion targets leading against the archer's preferred direction of shooting. This skill is accomplished in the return target motion initiated by the second still target hit. Finally by using an embodiment of the present invention that introduces a randomized delay 125 before target activation will develop the archer's skills suitable for reacting to a stalking event. A stalking event is defined as an encounter with a target in an archery range setting or as an encounter with a game animal in a hunting situation.

Once the cycle of still and moving target shots have been completed, the archer can reinitiate the cycle without moving from a firing position. The number of shots that the archer is able to make without moving from the firing position is limited by the number of arrows in the archer's possession at the firing line. With the present invention, an archer can concentrate on technique and precision shooting, making corrections in form and method without interruption to reset the target. Once all the arrows are expended, the archer simply retrieves the arrows.

Figure 2:
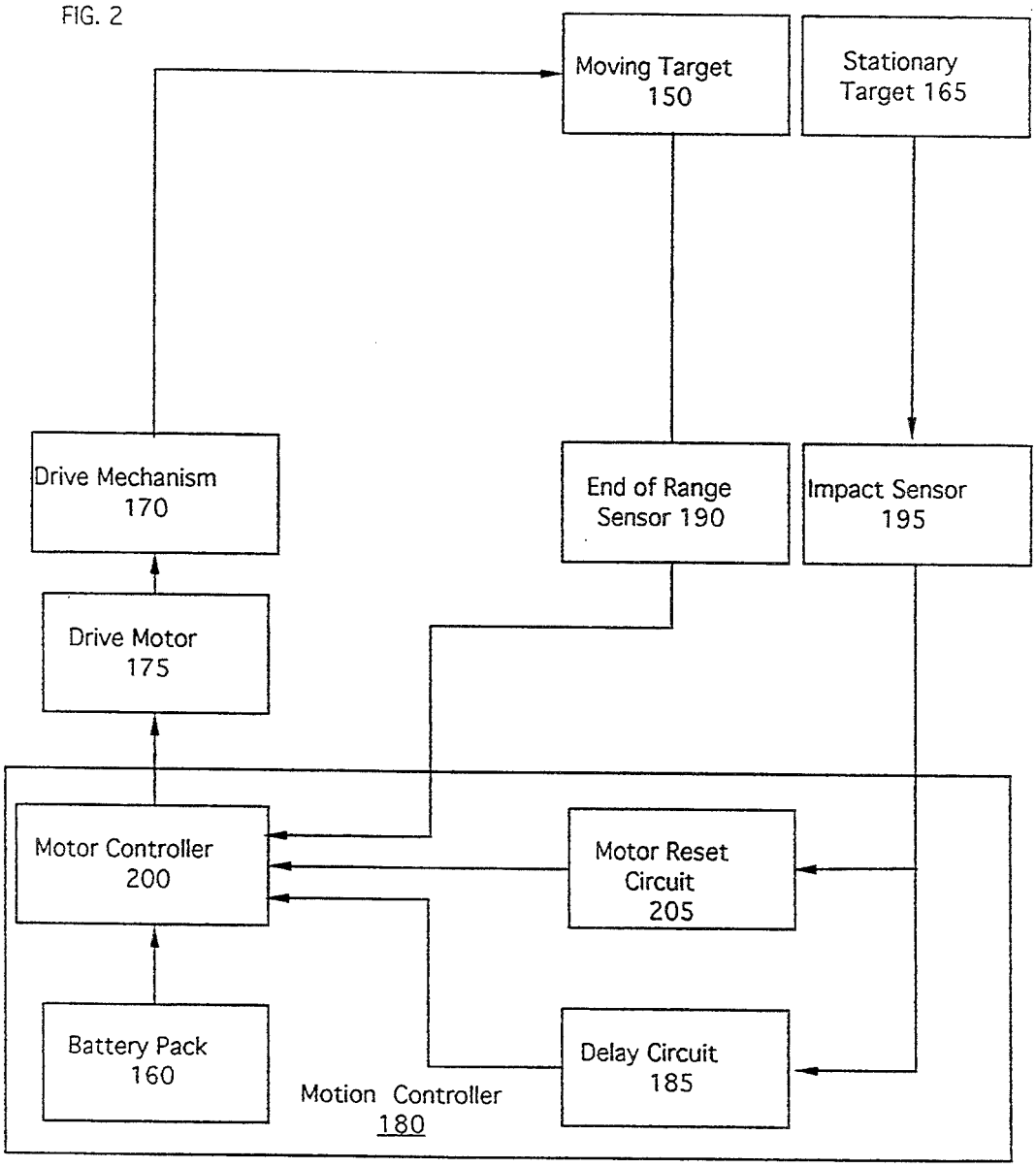
FIG. 2 is a block diagram of an embodiment of the present invention.

FIG. 2 describes a block diagram of an embodiment of the present invention. The apparatus includes a moving target 150 that is suspended in an operable manner by a cable 152 or another form of structure and is moved perpendicularly across a target range in a manner that allows an archer to aim and fire an arrow at the moving target 150. Moving and/or stationary targets 150,165 are sized and constructed from materials that allow the archer to utilize various arrow types and range distances appropriate for the level of archer skill. Examples of material composition for the moving or stationary targets 150,165 are wood, plastic, a quilted or woven fabric stretched over a frame. The cable 152 or other structure must allow the moving target 150 the ability to travel a desired distance across a target range and return to the original starting point. A full cycle for the moving target 150 is defined as the moving target 150 traveling across the range and returning to its original starting position. A stationary target 165 is operably connected to an impact sensor 195 that senses an impact of an arrow on the stationary target 165. The impact sensor 195 initiates a delay circuit 185 which counts down over a desired time period and trips a motor reset circuit 205 setting the drive motor 175 polarity settings to drive the moving target 150 across the target range. Once the delay period has expired, the delay circuit 185 activates a motor controller circuit 200. The motor controller circuit 200 activates a drive motor 175. The drive motor 175 and the other electrical components may be powered either by a standard power source (not shown) or a battery pack 160. The drive motor 175 is operably connected at least a single type of different drive mechanisms 170 to move the moving target 150 across a range of desired target range widths. Examples of the drive mechanisms 170 that can be used to drive the target can be divided into two types of mechanisms. The first style of drive mechanism 170 simply drives only the moving target 150 across the target range. The second style of drive mechanism 170 includes the drive motor 175, motor controller 180, and the moving target 150 in a single unit that translates across the target range. As the moving target 150 completes its travel across the target range, an end of range sensor 190 senses the target as it completes a half cycle. The end of range sensor 190 activates the motor controller circuit 200 which deactivates the drive motor 175.

Figure 3:
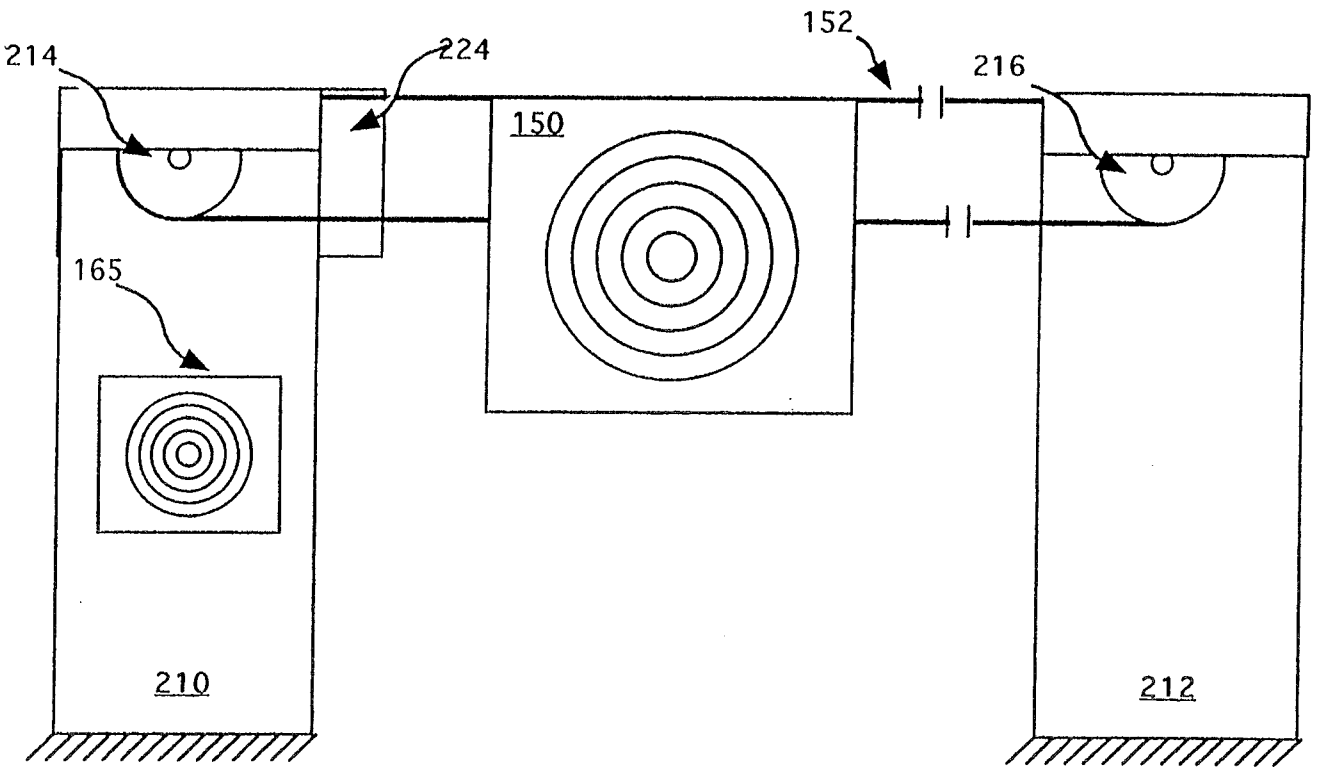
FIG. 3 is an embodiment of the present invention showing a moving target with a stationary drive mechanism.

FIG. 3 presents an embodiment of the archery target range utilizing the first type of drive mechanism 170 includes a pair of stands 210,212 or other forms of support that suspends a cable 152 rotatably mounted on a first and second pulleys 214,216 across a desired range of motion for the moving target 150. Cable 152 is formed in a continuous loop around both pulleys 214,216. Moving target 150 is operably attached to the cable in a manner that allow the moving target 150 to be drawn by the cable 152 across the target range between the stands 210,212. Moving target 150 motion is initiated by an arrow that impacts a stationary target 165 and is sensed by an impact sensor 195. One of the pulleys 214,216 is operably attached directly or indirectly to a drive motor 175. An example of indirect linkage to the drive motor would include a torque-speed converter (not shown) like a speed reducer gearbox. An end of range sensor (e.g. a limit switch) 190 is mounted on either stand 210,212 or on moving target 150 to signal the motion controller 200 when moving target 150 reaches either stand 210,212.

Electronics and electromechanics of the present invention are contained in a housing 224. The motion controller 180 runs the drive motor 175 in the direction indicated by the motor reset circuit 200. The drive motor 175 direction maybe regulated by the motion controller 180 switching the drive motor's 175 polarity upon contact with the impact sensor 195. Motion controller 180 includes a delay circuit 185 that will effectively delay the drive motor 175 activation in sufficiently to allow the archer to reload an arrow and return to a firing stance. The motor controller circuit 200 would require an input from the delay circuit 185 prior to activation. Other components of the motion controller 180 are motor reset circuit 205 that is able to reverse the drive motor 175 to complete a full cycle of motion. An example of this motor reset circuit 205 would be a relay or a switch 253 that would reverse the drive motor's 175 polarity upon the activation of any appropriate impact sensor 195.

Figure 4:
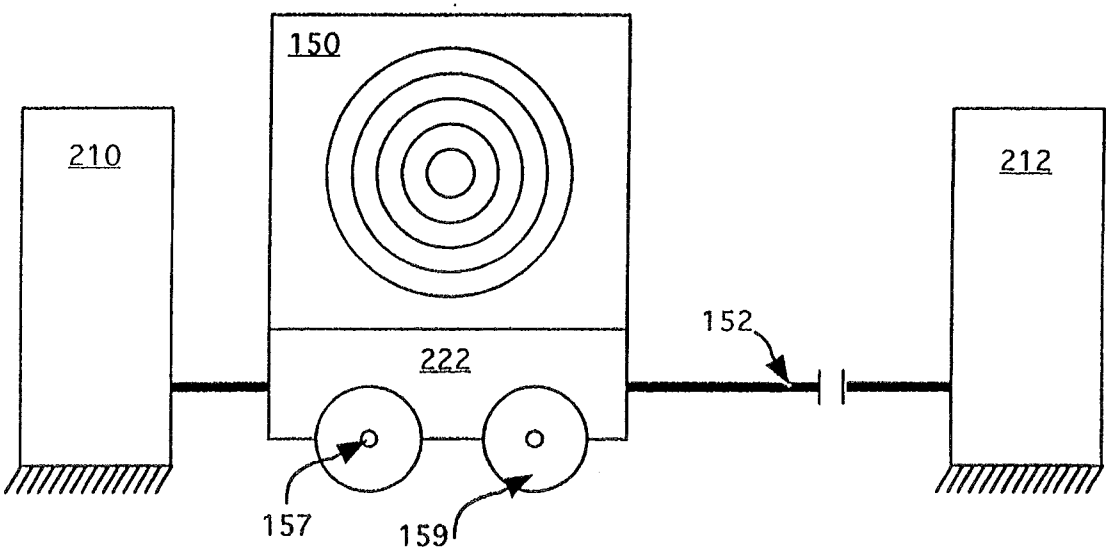
FIG. 4 is an embodiment of the present invention showing a moving target including a mobile drive mechanism.

FIG. 4 shows an embodiment utilizing a drive mechanism 170 that includes the drive motor 175, the motion controller 180 and other components in motion with the moving target 150. A stationary target 165 is not required in this embodiment as moving target 150 fulfills both stationary and moving target 165,150 roles. This embodiment also includes a wheeled carriage base 222 that draws the carriage base 222 and moving target 150 along a single cable 152 stretched between a pair of stands 210,212. Pulleys 214,216 are also not required in this configuration as the cable 152 is fixed between stands 210,212.

Figure 5:
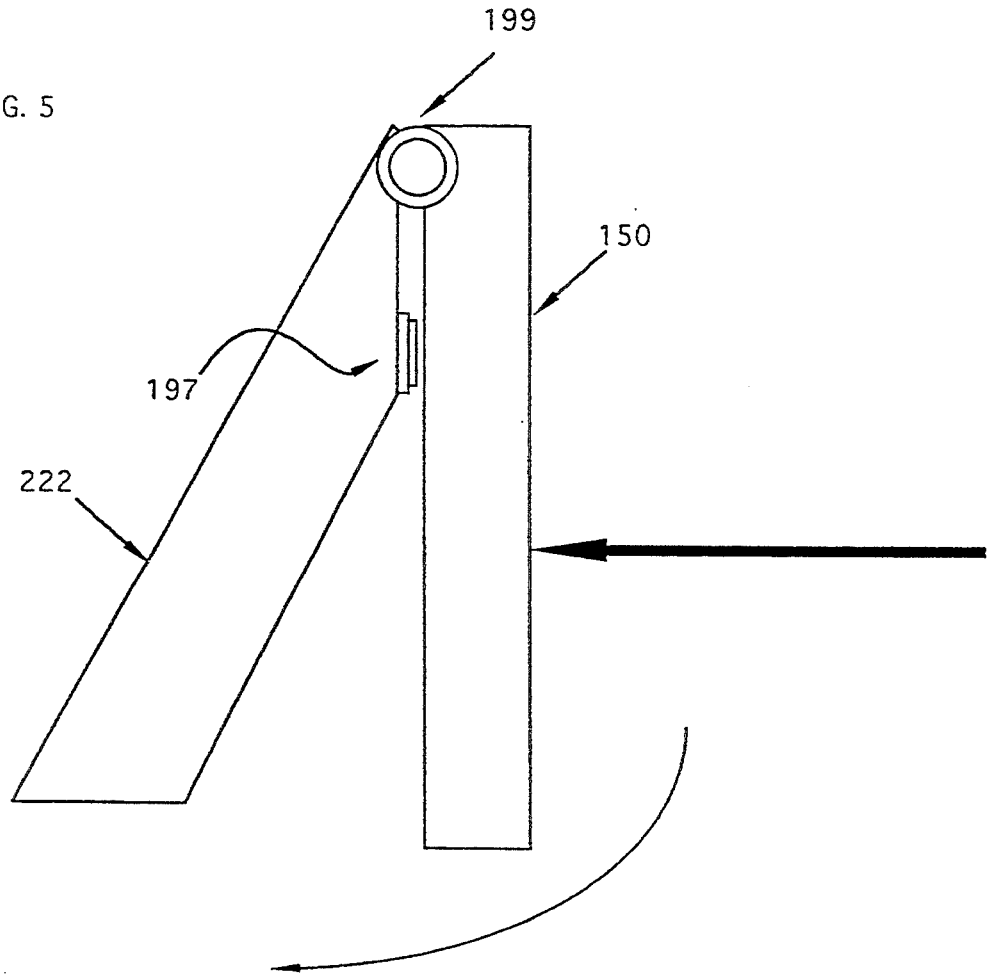
FIG. 5 is an embodiment of an impact sensor and target interface.

Moving target 150 is attached on the frontal portion of the carriage base 222 and is linked mechanically and electrically to the carriage base 222. A mechanical linkage between the moving target 150 and the carriage base 222 may require that the target is capable of some motion to facilitate the arrow impact sensor 195. FIG. 5 describes an example of an impact sensor 195 by combination of a momentary contact switch 197 and the moving target 150. Moving target 150 is hinged in a manner to close momentary contact switch 197 by the arrow impact. By mounting the momentary contact switch 197 substantially near a hinged top edge of the moving target 150, even a glancing hit to the moving target 150 will initiate the delay circuit 185. An effective location of the momentary contact switch 197 would be nearly coincident to a mechanical linkage pivot 199 to use a moment arm advantage of this configuration. The force of an arrow impact on the moving target 150 amplified if it is struck at a position on the moving target 150 lower than the location of the momentary contact switch 197. Other examples of sensors that could replace the momentary contact switch 197 include strain gages, diaphragm sensors, vibration or other impact sensors. Other forms of mechanical linking could include a pivotal plate with a centralized fulcrum, a rotational mount or a fixed mounting.

The wheeled carriage base 222 is sturdy enough to support the components contained within the carriage, but light enough to allow the drive motor 175 to move the carriage along the cable 152 at desired speeds and to allow suitable portability of the entire system. External covering of carriage base 222 is a light weight ballistic covering that shields the components from the arrows. Examples of ballistic coverings include fabric coverings, sheet metal, sheet plastic or ceramic. The impact of an arrow on the carriage base 222 should not allow the arrow to penetrate to the electronics or mechanical interface. Wheeled carriage base 222 may include a drive axle 157 operably connected to the drive motor 175 in a manner that allows a set of wheels 159 assist in driving the wheeled carriage base 222 across the target range in conjunction with the primary drive mechanism 170. Cabling 152 serves as a guidance and/or drive component in all embodiments of the present invention.

Other configurations of the system include aspects of remote control. Impact sensor 195 may be bypassed by feeding a signal from a remote source to initiate the delay circuit 185 or directly to the initiation of the drive motor 175. This remote embodiment may be accomplished with an infrared, radio, wire transmission or other transmission techniques. The desired use of this variation to the basic system would allow the target to be activated by a walking archer, simulating a stalking event on a hunting path.

EXAMPLES

Figure 6:
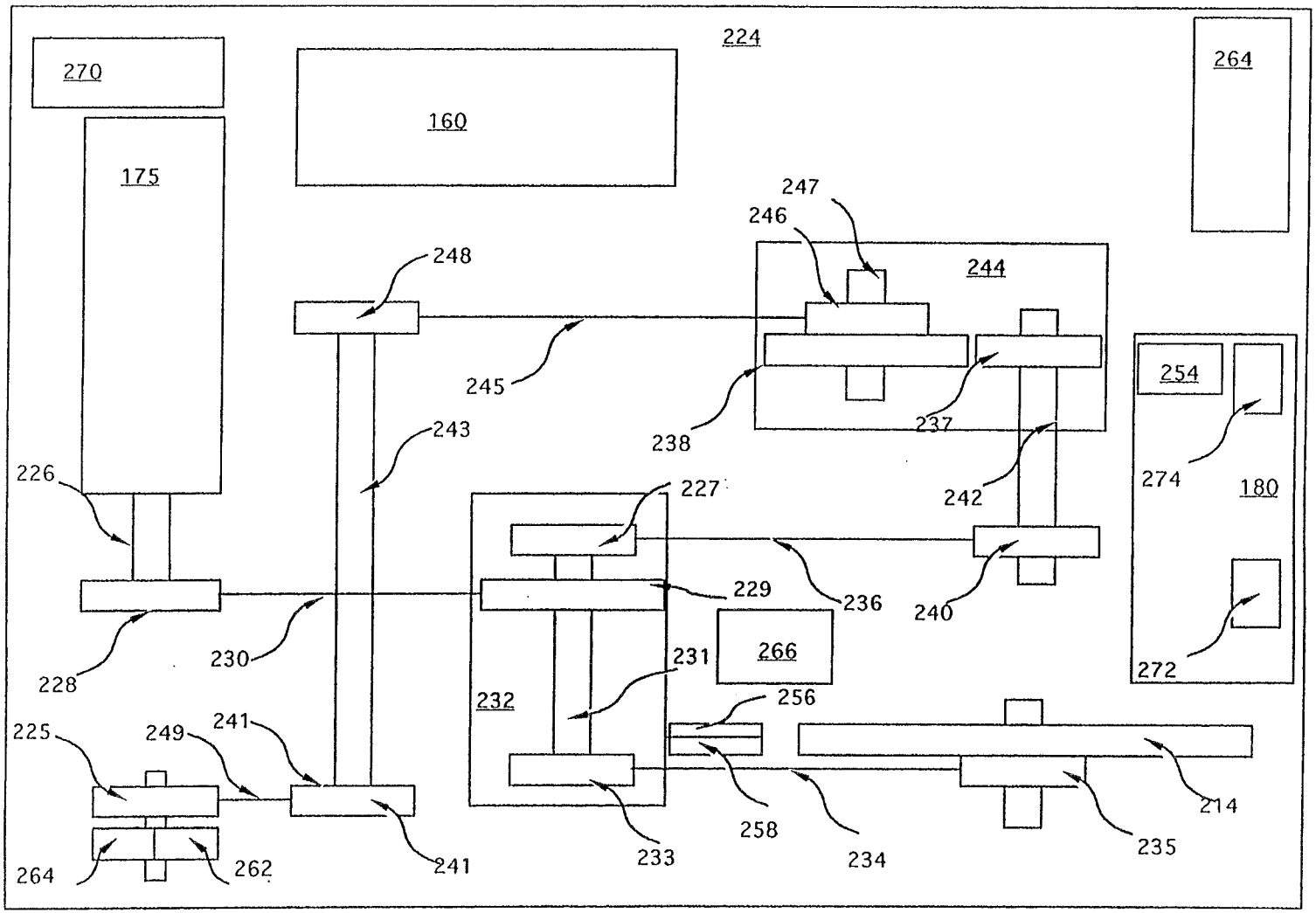
FIG. 6 is a mechanical schematic of an embodiment of the present invention.
Figure 7:
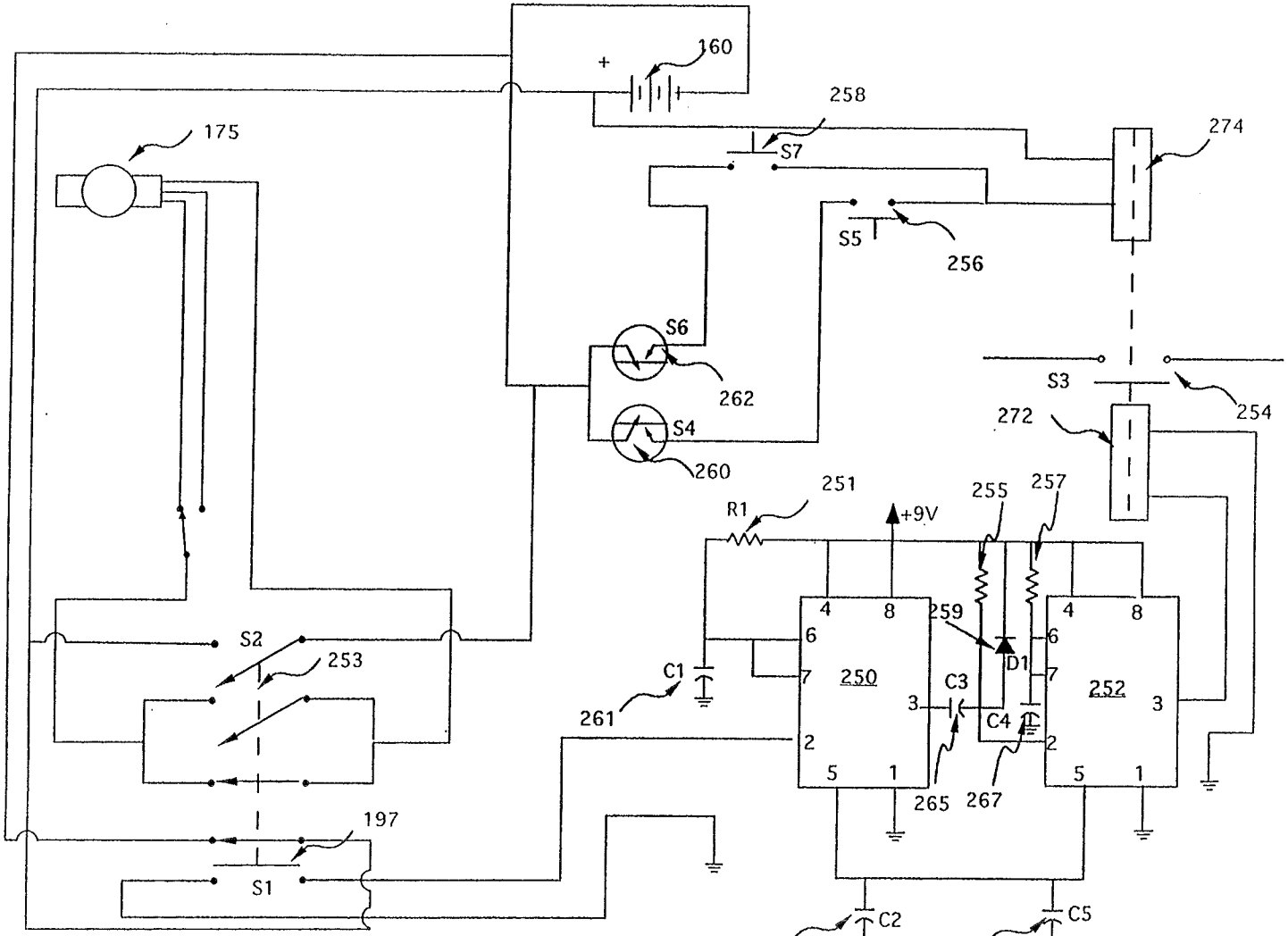
FIG. 7 is an electrical schematic of an embodiment of the present invention.
Figure 8:
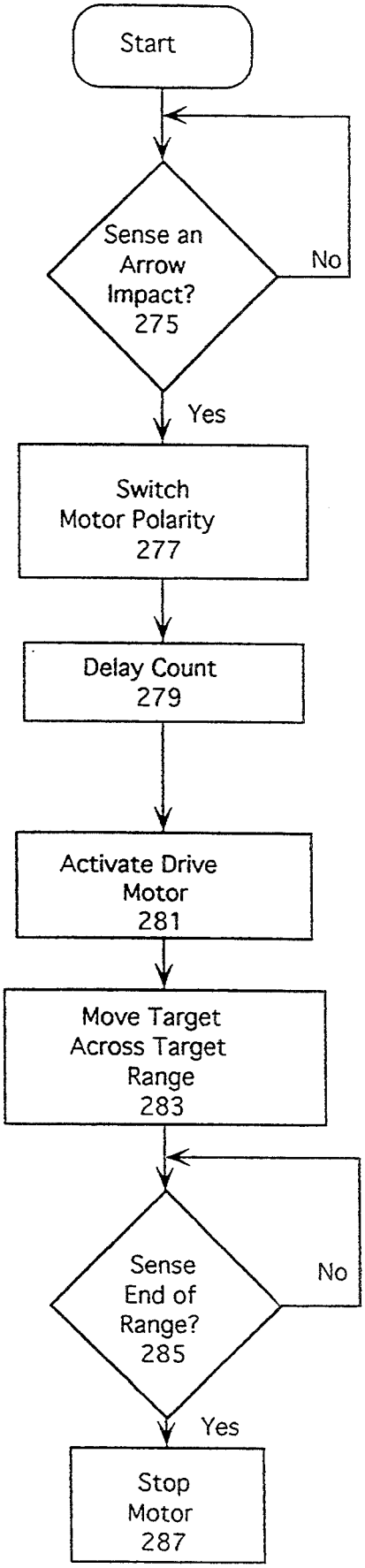
FIG. 8 is a flow chart of the electromechanical process of the present invention.

A working example of the present invention and method is described in FIGS. 6, 7 and 8. FIG. 6 is a mechanical schematic of the present invention. The device configuration is of a drive mechanism 170 of the first type where only the moving target 150 is moved across the target range. This configuration has a centralized control and drive housing 224 that includes the drive motor 175, the motion controller 180, the drive mechanism 170, battery pack 160 and end of range sensor 190. Drive motor 175 is a 12 VDC motor capable of at least two speeds, and is operably powered by a 12 VDC battery in the battery compartment 160. Drive motor shaft 226 has an operable drive pulley 228 attached to the end of the drive shaft 226. All pulleys and gear boxes are supported by shafts mounted to the housing 224. A drive belt 230 connects the drive pulley 228 to an intermediate gearbox 232. Intermediate gearbox 232 includes an input gear 229, transfer shaft 231, reduction output pulley 227 and a drive output pulley 233. A first output belt 234 is connected to the drive output pulley 233 and a drive pulley 235 co-linked to one of the main pulleys 214,216. The rotational velocity of the drive motor 175 is reduced by intermediate gearbox 232 to allow a higher torque/slower speed conversion to the main pulley 214. The reduction output pulley output from intermediate gearbox 232 is a first of four sets of gear/pulley (speed/velocity) reductions ultimately connecting to a pair of rotatably operable mercury switches 260,262 that enable a drive motor 175 deactivation when at least a single end of range sensor 256,258 is activated. The second speed reduction runs from the reduction output pulley 227 to the second output belt 236 to a second pulley 240. Second pulley 240 is connected to a first drive shaft 242 that transfers rotational motion to a second gear box 244 that reduces the rotational speed to a third drive pulley 246. Second gearbox 244 includes first gear 237 interfacing with second gear 238 to achieve a rotational velocity reduction. Second gear 238 is co-mounted on support shaft 247 with third drive pulley 246. Third drive pulley 246 is attached with a fourth drive pulley 248 with a third output belt 245. The fourth drive pulley 248 is attached to a second drive shaft 243 translating the rotational motion to a fifth drive pulley 241 that connects to a pair of mercury switches 260,262 with a fourth output belt 249. The reduction in velocity and rotation through the four stages of pulleys and gears is sufficient to reduce the rotation of the mercury switches S4 and S6 260,262 to rotate each switch into an operable position to enable the drive motor 175 deactivation when the end of range is reached by the moving target 150. Drive housing 224 contains structure for mounting all components within the structure including mounting structure for a terminal block 264 for connecting exterior sensor and power lines (not shown), and switch mounting brackets 266, 268, 270.

Referring to FIG. 7, the electronics function as follows: a momentary contact switch S1 197 is closed creating a signal pulse to a first IC 555 timer 250 and changing the polarity setting of the drive motor by changing the setting on a switch S2 253, a double pull single throw switch. The first IC 555 timer 250 acts in conjunction with a second IC 555 timer 252 to form a delayed action monostable multivibrator circuit. The supporting components for the timing circuit are given as R1 251, R2 255, R3 257, D1 259, C1 261, C2 263, C3, 265, C4 267, C5 269. The values of these components are R1(470 kΩ) 251, R2(10 kΩ) 255, R3(860 kΩ) 257, D1(IN914) 259, C1(10 μF) 261, C2(0.01 μF) 263, C3(0.001 μF) , 265, C4(0.5 μF) 267, C5(0.01 μF) 269. The components that affect the functional output of the delay circuit are as follows: The time delay of 5.17 seconds is created by the product of 1.1*R1*C1. The output line (3) of the second IC 555 timer 252 will hold a high output for 0.43 seconds at the end of the delay cycle. This output signal duration is driven by the product of 1.1*R3*C4. At the end of a delay cycle, the second IC timer 252 output energizes a first solenoid 272 which closes the switch S3 254. Switch S3 254 is the main power switch to the drive motor 175. The drive motor 175 runs in an open loop format until a switch S5,S7 256,258 is closed by the moving target 150 reaching the end of the range. During this transfer period, the gear/pulley train described in FIG. 6 rotates the mercury switches S4,S6 260,262 into an enabled position such that when S5 256 or S7 258 is activated, a second solenoid 274 is energized which interrupts the power to the drive motor 175. Another impact of an arrow on a stationary target 165 will repeat the targeting sequence. In this configuration, all power is supplied by a 12 VDC battery source 160. Suggested changes to the prototype would include the elimination of S4 and S6 260,262 by wiring a relay switch through the activation of S2 253. This elimination of the mercury switches would necessarily eliminate the four stages of gear/pulley reductions required to rotate the mercury switches S4 and S6 260,262.

In FIG. 8, the flow chart of the method of the present invention target apparatus is described. The target apparatus is dormant until an impact or an arrow hit is sensed 275. The target apparatus switches the drive motor 175 polarity to reverse the drive motor 175 direction of rotation and begins a delay count 279. At the end of the delay count 279, the target apparatus activates a drive motor 281,175 which moves 283 a moving target 150 from one end of the target range to the other end. The end of range is sensed 285 as the moving target 150 reaches the other end of the target range. Once the target reaches the end of the range, the drive motor 175 is stopped 287.

The present invention teaches a target range that develops the archer's skill in a cost effective and simple manner. The apparatus and method focus the archer's attentions and concentration solely on the practice of archery. No interaction other than shooting an arrow is required. The design maximizes battery life by relying on mechanical interfaces to activate the electrical components of the present invention.

Although the present invention has been described with reference to preferred embodiments, workers skilled in the art will recognize that changes may be made in form and detail without departing from the spirit and scope of the invention.

What is claimed is:

1. An archery target apparatus comprising:

a first and a second stand separated, the first stand supporting a first drive mechanism receiving a cable loop that is suspended between the first stand and the second stand, the second stand supporting a second drive mechanism receiving the other end of the cable loop, the first stand and the second stand tensioning the cable loop to hold the cable loop in operable contact with the first and the second drive mechanisms, the first and the second stand containing an end of range sensor;

a drive motor attached to the first stand, an output shaft of the drive motor operably attached to the first drive mechanism moving the cable loop around the first and the second drive mechanisms;

a moving target affixed to the cable loop in a manner that presents a target to an archer, the moving target traveling between the first and the second stands while affixed to the cable loop and activating the end of range sensor when the moving target reaches the end of the target range;

a stationary target affixed to the first stand coupled to an electrical switch which senses impact of the stationary target by an arrow; and a motion controller circuit, which receives a first input signal from the electrical switch coupled to the stationary target and provides a motion controller circuit output to a delay circuit and a motor reset circuit, the delay circuit holding the first input signal for a preset period of time and then activating the drive motor, the motor reset circuit changing direction of the drive motor prior to activation, the motion controller circuit receiving a second input signal from the end of range sensor and providing an output deactivating the drive motor at end of target range.

2. The archery target apparatus of claim 1 wherein power to the target apparatus is provided by a battery unit allowing the archery target apparatus to be portable.

3. The archery target apparatus of claim 1 wherein the delay circuit generates a random delay that effectively prevents the archer from anticipating start of the moving target.

4. The archery target apparatus of claim 1 wherein the drive motor is a variable speed motor and the motion controller circuit runs the motor at a variable speed according to a desired speed profile.

* * * * *